US011786771B2

(12) United States Patent
Frießner

(10) Patent No.: US 11,786,771 B2
(45) Date of Patent: Oct. 17, 2023

(54) FIRE-FIGHTING DEVICE

(71) Applicant: FOGTEC Brandschutz GmbH, Cologne (DE)

(72) Inventor: Martin Frießner, Dormagen (DE)

(73) Assignee: FOGTEC Brandschutz GmbH, Cologne (DE)

( * ) Notice: Subject to any disclaimer, the term of this patent is extended or adjusted under 35 U.S.C. 154(b) by 449 days.

(21) Appl. No.: 17/046,034

(22) PCT Filed: Feb. 14, 2019

(86) PCT No.: PCT/EP2019/053708
§ 371 (c)(1),
(2) Date: Oct. 8, 2020

(87) PCT Pub. No.: WO2019/201492
PCT Pub. Date: Oct. 24, 2019

(65) Prior Publication Data

US 2021/0154507 A1 May 27, 2021

(30) Foreign Application Priority Data

Apr. 19, 2018 (DE) ..... 10 2018 109 305.5

(51) Int. Cl.
*A62C 37/36* (2006.01)
*A62C 3/07* (2006.01)
*A62C 5/00* (2006.01)

(52) U.S. Cl.
CPC ..... *A62C 37/04* (2013.01); *A62C 3/07* (2013.01); *A62C 5/006* (2013.01)

(58) Field of Classification Search
CPC ..... A62C 37/04; A62C 3/07; A62C 5/006
USPC ..... 169/60–62, 43
See application file for complete search history.

(56) References Cited

U.S. PATENT DOCUMENTS

| | | | |
|---|---|---|---|
| 5,506,509 | A | 4/1996 | Susak |
| 5,517,920 | A | 5/1996 | Hinz et al. |
| 5,915,480 | A | 6/1999 | Yemelyanov et al. |
| 2005/0257937 | A1 | 11/2005 | Fabre |
| 2013/0104764 | A1 | 5/2013 | Metcalfe et al. |

FOREIGN PATENT DOCUMENTS

| | | | |
|---|---|---|---|
| CN | 1030826 | A | 2/1989 |
| CN | 1119735 | A | 4/1996 |
| CN | 101806260 | A | 8/2010 |
| CN | 202191628 | U | 4/2012 |
| CN | 202230340 | U | 5/2012 |

(Continued)

OTHER PUBLICATIONS

International Searching Authority/EP, International Search Report and Written Opinion of the International Searching Authority, Application No. PCT/EP2019/053708, dated May 14, 2019, with English translation of the search report, 14 pages.

(Continued)

*Primary Examiner* — Christopher S Kim
(74) *Attorney, Agent, or Firm* — Sunstein LLP

(57) ABSTRACT

Fire-fighting device with at least one generator arranged for discharging fire-fighting agent, an electrically triggerable ignition means arranged in the generator, the ignition means being controllable via an at least two-pole control connection. A bypass circuit electrically arranged at the control connection detects a triggering of the ignition means and closes a switch when the ignition means is released.

14 Claims, 2 Drawing Sheets

(56) References Cited

FOREIGN PATENT DOCUMENTS

| | | | |
|---|---|---|---|
| CN | 202605590 | U | 12/2012 |
| CN | 102908742 | A | 2/2013 |
| CN | 103887714 | A | 6/2014 |
| CN | 204612619 | U | 9/2015 |
| DE | 196 38 626 | A1 | 3/1998 |
| DE | 103 45 462 | A1 | 5/2005 |
| EP | 1 609 507 | A1 | 12/2005 |
| EP | 1 609 507 | B1 | 7/2012 |
| SU | 814 370 | A1 | 3/1981 |
| SU | 814370 | A1 | 3/1981 |
| WO | 2013/044961 | A1 | 4/2013 |

OTHER PUBLICATIONS

German Patent Office, Office Action, Application No. 10 2018 109 305.5, dated Jan. 14, 2019, 9 pages (in German).

Chinese National Intellectual Property Administration, First Office Action, Application No. 201980026662.7, dated Sep. 13, 2021, 15 pages (English translation).

FIRE-FIGHTING DEVICE

CROSS-REFERENCE TO RELATED APPLICATIONS

This application is the national phase entry of international patent application no. PCT/EP2019/053708 filed Feb. 14, 2019 and claims the benefit of German patent application No. 10 2018 109 305.5, filed Apr. 19, 2018, the disclosures of which are incorporated herein by reference in their entirety.

TECHNICAL FIELD

The subject matter relates to a fire-fighting device, a system including a fire-fighting device and a method of operating such a system.

BACKGROUND ART

A wide range of technologies are being used for fire fighting. Besides the classical sprinkler systems for fire fighting, there exist systems with high-pressure water mist as well as systems with aerosols, which are utilized for fire extinguishing. In the latter systems the aerosol, which is formed from finely sputtered solids, is discharged by so-called generators. Generators are ignited electrically and after ignition they discharge the aerosol. This is unproblematic as long as only one generator per control unit is used. However, in applications where larger areas have to be protected, it can be useful to connect several generators in series along the same control line. In this case, however, it may happen that not all generators along this row (line) trigger at the same time, so that in case of a fire, i.e. when the control line is activated, it cannot always be guaranteed that all generators connected to this control line are actually triggered.

For this reason, the subject matter was based on the object of providing a fire-fighting system in which a reliable release of all generators along a common control line is guaranteed.

SUMMARY OF THE INVENTION

This object is solved by a fire-fighting device according to claim 1. A generator is provided, with which a fire-fighting agent can be discharged. A generator can have for example a cartridge, in which a fire-fighting agent is stored. The cartridge can be activated by an ignition impulse and the fire-fighting agent can be discharged. In particular, it is possible to open the generator and discharges the fire-fighting agent by an exothermic reaction. In particular, an aerosol generator can be used, which releases a solid aerosol during an ignition process. Such generators are commonly known.

In the generator, especially in the cartridge of the generator, an ignition means is arranged. This ignition means can be triggered by an electrical ignition pulse, also called ignition current. At the moment at which the igniter is triggered, a gas pressure is built up and the fire-fighting agent is discharged.

To ignite the ignition means, it can be controlled via a two-pole control connection. The ignition current and the ignition voltage can be applied to the control connection. If the ignition current exceeds a limit value, the ignition means can trigger and activate the generator.

As already explained, it cannot always be guaranteed that in case of an electrical series connection of several fire-fighting devices the generators of all fire-fighting devices will trigger simultaneously. If the ignition means is formed in such a way that in case of ignition an electrical connection between the two poles of the control connection is disconnected or disturbed, the current flow along the series connection can be disconnected when a fire-fighting device is triggered and thus upstream or downstream fire-fighting devices in the series can no longer be supplied with a sufficient ignition current. It has now been recognized that a bypass circuit can be arranged at the poles of the control connection, by which this disconnection of the current flow can be prevented even in the event of a triggering of the ignition means and a consequent disconnection of the electrical connection. With the help of the bypass circuit a triggering of the ignition means can be detected. The bypass circuit is arranged in such a way that it closes a switch for a triggered ignition means and thus short-circuits the two poles of the control connection or connects them with low resistance. This means that in case of ignition of the ignition means the switch bypasses the ignition means and the ignition current can still flow between the poles of the control connection.

In particular, the switch is such that if ignition voltage is applied, it is closed after a single activation. An activation criterion for activating the bypass circuit can be a resistance of the ignition means. In particular, the criterion can be fulfilled in the case of a high-resistance ignition means, i.e. when the ignition means has ignited and possibly a line is disconnected or disturbed, so that the switch is then closed. The switch is then used to bypass the ignition means and the ignition current flows through the fire-fighting device to upstream and/or downstream fire-fighting devices where it can ensure reliable ignition of the ignition means. This ensures that even those fire-fighting devices can be triggered in which the ignition means may be inert and/or require an ignition current that is applied over a longer period of time in order to trigger reliably.

To bypass the ignition means by the switch, it is proposed that the bypass circuit is electrically connected in parallel to the control terminal. Thus the bypass circuit is connected to the poles of the control terminal in parallel with the ignition means.

The bypass circuit can be used to monitor an ohmic resistance over the ignition means. In the non-triggered state a current flows almost without being hindered through the ignition means. The ohmic resistance is close to 0Ω, especially not more than 3Ω, especially between 1 and 4Ω. By the bypass circuit, a very low resistance above the ignition means is thus detected. Immediately after ignition of the ignition means, however, a high resistance, especially greater than 3Ω, preferably greater than 10Ω can be measured over the ignition means. Such a high resistance can lead to the bypass circuit to activate and close the switch.

The bypass circuit preferably has a current mirror. According to an embodiment the current mirror is connected asymmetrically between the poles of the control connection. This means that the first path (reference path) of the current mirror is connected to one pole of the control connection via a resistor of near 0Ω and the second path (follow path) of the current mirror is directly connected to this pole of the control connection. In this way the first path of the current mirror can be influenced depending on the current flow over the ignition means, which also flows over the resistor. As a consequence of influencing the first path of the current mirror, a switch can be switched via the second path of the current mirror due to the dependence of the second path of the current mirror to its first path.

According to an embodiment it is proposed that the switch is an electronic switch. The electronic switch is preferably a TRIAC or a thyristor. This switch is preferably switched via the second path of the current mirror. In the case of an ignited ignition means, when its resistance becomes high, the voltage at the gate terminal of the switch increases, making the switch conductive. This is due to the asymmetry of the two paths of the current mirror.

According to an embodiment, it is proposed that the generator is an aerosol generator. In particular, this is a solid aerosol generator. Such a generator has a quantity of solid matter of about 30 g to 500 g, which is the quantity that is discharged in case of ignition of the ignition means. The aerosol is suitable to bind free radicals of the fire and thus extinguish a fire.

According to an embodiment it is proposed that the ignition means is a pyrotechnic igniter. A pyrotechnic igniter is ignited by an electric pulse, after which an exothermic pyrotechnic reaction takes place. This reaction creates a gas pressure inside the generator, by which the aerosol can be discharged from the generator.

In particular, the ignition means is a resistance wire. This resistance wire has a defined electrical resistance. If an ignition current is applied to the resistance wire, it heats up. The resistance wire is preferably connected between the poles of the control connection. By the heating of the resistance wire, the ignition means is ignited and the generator is triggered. As already explained, the ignition of the ignition means via the resistance wire can take different amounts of time. However, when an ignition current is applied via series-connected fire-fighting device, this can result in the ignition moment of the respective ignition means being different. If an ignition means triggers, the ignition current may be interrupted. If this is the case, this can lead to the other ignition means no longer reliably triggering along the series connection of several fire-fighting devices. For this reason, the bypass circuit according to the subject matter with bypassing of the ignition means in case of ignition is proposed.

The above mentioned problem occurs in particular in environments where the input voltage at the control connection is variable. By the proposed bypass circuit, reliable ignition can be achieved, especially with voltage bands between 10V and 40V. This means that according to the subject matter, no a defined voltage has to provide a defined ignition current, but also voltages of different levels can provide a reliable triggering of all ignition means along a series connection of several fire-fighting devices. The voltage band is especially formed between 16.8V and 30V. It is noted that the voltage band is preferably formed between 10V and 40V, especially between 15V and 35V, especially preferred between 16V and 31V, especially between 16.8V and 30V.

Other voltage bands are also possible. It has been recognized that the fire-fighting device can still be operated safely even if different voltages are applied to the control connection. By appropriate dimensioning of the bypass circuit a safe triggering of the ignition means can be realized also over a voltage band of several 10V. The minimum ignition voltage can be approx. 4 V per fire-fighting device. This results in a voltage of 16V across the entire row for four fire-fighting devices. If the voltage across the row is 30V, a voltage of 7.5V is applied to each fire-fighting device. In this voltage range between 4V and 7.5V, reliable ignition must be ensured.

In addition to reliable triggering, it can also be useful to be able to monitor by means of a measuring current whether a fire-fighting device along the series connection has triggered or not. According to another aspect, which is inventive by itself and can be combined with all the features described in here, it is proposed that a circuit for storing an ignition process is electrically connected in series with the ignition means.

At the moment of ignition, a high current flows through the ignition means, especially through the series connection of the ignition means. It is proposed that the circuit has at least one fuse which is triggered during an ignition process and a switch which bypasses the fuse. The fuse is realized in particular by a melting fuse. In case of ignition current, the fuse may trigger. The switch can be arranged in such a way that it is closed when ignition voltage is applied, but open when lower voltages are applied. Thereby it is possible that at a low measuring current, which leads to a low applied voltage, the circuit for storing the ignition process presents a disconnection of the circuit or at least a defined resistance, and no measuring current or a measuring current lower than with an intact fuse flows. By this it can be detected whether at least one fire-fighting device has been triggered.

In case of a subsequent ignition, however, the voltage and current can be so high that the switch in the circuit for storing the ignition process is being closed and the ignition current can flow over the switch instead of the fuse. Then, ignition can take place in other ignition means. This is particularly relevant because the fuse is triggered by the first ignition of an ignition device. In order to prevent the circuit for storing the ignition process from suppressing the ignition current via the further fire-fighting devices along the series connection, the switch is closed when the ignition voltage and the ignition current are applied.

In case of a fire, i.e. when a fire alarm system reports a fire and the fire is to be extinguished, the fire-fighting device is set to an ignition mode. In ignition mode, ignition voltage and ignition current are applied to the inputs of the control connection. If several fire-fighting devices are connected in series, the same ignition current is applied to all fire-fighting devices. This ignition current is dimensioned in such a way that it is normally large enough to trigger the ignition means.

In addition to the case of a fire, there is also the case of monitoring. In this case, no fire is reported, but it should only be monitored whether the fire-fighting device is still properly connected to the control circuit, e.g. fire alarm system or fire-fighting system via its control connections. In this monitoring case a low measuring current, which is lower than an ignition current, in particular an order of magnitude lower than an ignition current, is applied to the poles of the control connection. This measuring current does not lead to an ignition of the ignition means and flows via the ignition means. The circuit for storing the ignition process is arranged in such a way that it blocks in case of the measuring current or presents a defined resistance. This circuit can then be used to determine that at least one fire-fighting device has ignited along a row.

In case of a fire, however, the switch remains closed and bypasses the opened fuse, so that the ignition current can continue to flow through the circuit for storing the ignition process.

Another aspect is a system with a control circuit, in particular an output of a fire alarm system or fire-fighting system and at least two fire-fighting devices electrically connected in series to the control circuit. In this system, in the event of a fire, an ignition current is applied to the series connection of the fire-fighting device. The ignition current is dimensioned in such a way that the ignition means can ignite. In the monitoring case, only a measuring current is applied which can flow almost without being hindered over the ignition means without triggering it.

It can happen that an ignition means ignites and forms a short circuit during the ignition. Such a triggering case can also be detected with the circuit according to the subject matter for storing the ignition process. In spite of a short circuit over the ignited ignition means, it is ensured that in case of the measuring current the circuit for storing the ignition process remains open and thus no measuring current or a measuring current over a defined resistor can flow.

Another aspect is a method for operating such a system. In a monitoring mode, the control circuit provides a measuring current which is lower than the ignition current for igniting the ignition means. In an ignition mode, i.e. in case of fire, an ignition current is provided by the control circuit. The ignition current is used to ignite at least one ignition means of a fire-fighting device. Preferably, all fire-fighting devices are ignited simultaneously by the ignition current. However, this cannot be guaranteed. For this reason, it is proposed that a bypass circuit is activated by the ignition of the ignition means associated with the bypass circuit. When the bypass circuit is activated, its switch is closed so that the ignition medium is short-circuited and the ignition current can flow through the switch regardless of the state of the ignition means.

This means that if the ignition medium ignites and opens, the ignition current continues to flow in an unhindered way via the switch which is then closed and can ensure that at least a second of the ignition means of the fire-fighting devices is ignited by the ignition current. This bypass circuit ensures that the ignition current can continue to flow through the means of ignition of the fire-fighting devices connected in series until several or all fire-fighting devices have ignited.

On the other hand, immediately after an ignition current has flown, the circuit for storing the ignition process is activated. Here, a switch is controlled in such a way that it is open at a measuring current or forms a low resistance, but is closed at an ignition current. This circuit allows the ignition current to flow in an unhindered way, but in monitoring mode the measuring current does not flow or flows over a defined resistor, so that it can be determined that at least one ignition has taken place.

As already explained, the system according to the subject matter is particularly suitable for environments where no constant voltage can be provided. This is especially the case in a rail vehicle, where voltages between 10V and 40V can be provided by the on-board power supply network. All these voltages must guarantee a safe ignition of all fire-fighting device in case of a fire. This is ensured by the bypass circuit according to the subject matter, although different voltage levels are available for switching or ignition.

BRIEF DESCRIPTION OF THE DRAWINGS

In the following, the subject matter is explained in more detail by means of a drawing showing embodiments. In the drawing show.

DETAILED DESCRIPTION OF SPECIFIC EMBODIMENTS

Figure 1:
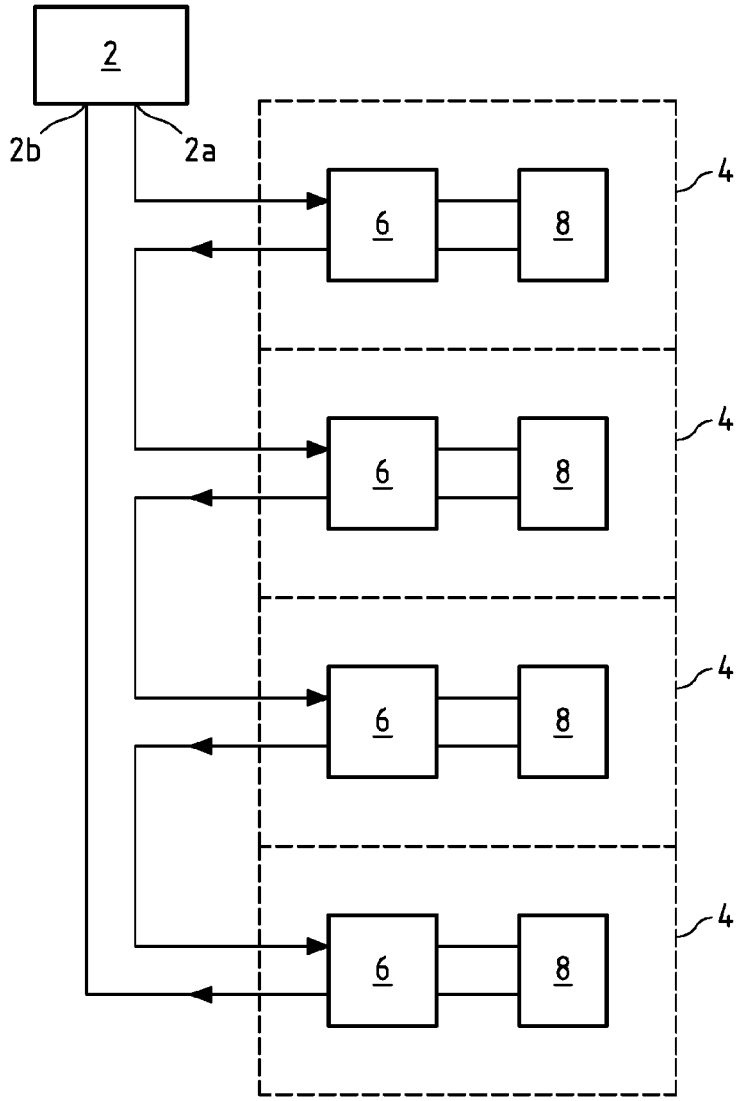
FIG. 1 a system with a control circuit and a row of fire-fighting devices.

FIG. 1 shows in a schematic block diagram a system with a control circuit 2, for example a fire alarm system or fire-fighting system, connected to a number of fire-fighting devices 4, each with at least one circuit 6 comprising a bypass circuit and a generator 8. The control circuit 2 has a digital control output with two poles 2*a*, 2*b*. The fire-fighting devices 4 are electrically connected in series to the control circuit 2.

In case of a fire, when a fire is to be fought or extinguished, it is necessary that if possible all generators 8 of control circuit 2, which are electrically connected in series, actually trigger. Since the generators 8 are connected in series, this is not always the case of conventional systems.

In a generator 8, which can be an aerosol generator, an ignition means can be arranged, for example an ignition wire, which is heated by a current flow and triggers a pyrotechnical ignition.

The current flow is caused by the ignition current between the poles 2*a*, 2*b*.

At the moment when an ignition means of a generator 8 triggers, an electrical disconnection can occur in the ignition means, for example in the ignition wire. However, this leads to an interruption in the current flow between the poles 2*a*, 2*b*.

If in this case the ignition means of the other generators 8 along the line are not yet sufficiently heated and activated for ignition, this disconnection can cause the ignition process in the other generators 8 to be interrupted and they will not ignite any more.

This problem is arises in particular when the voltage at poles 2*a*, 2*b* is variable, for example in the case of applications in rail vehicles. There, the control circuit 2 is connected to the internal voltage supply of the rail vehicle, which has a relatively high fluctuation range of for example at least 10 V. This fluctuation range of the voltage leads to different currents in the ignition means of the generators 8, so that the duration of the current flow for an effective ignition can be different. This is precisely what leads to the fact that not all generators 8 along a line will trigger simultaneously and thus, if necessary, generators 8 will not be triggered at all, as described above.

Figure 2:
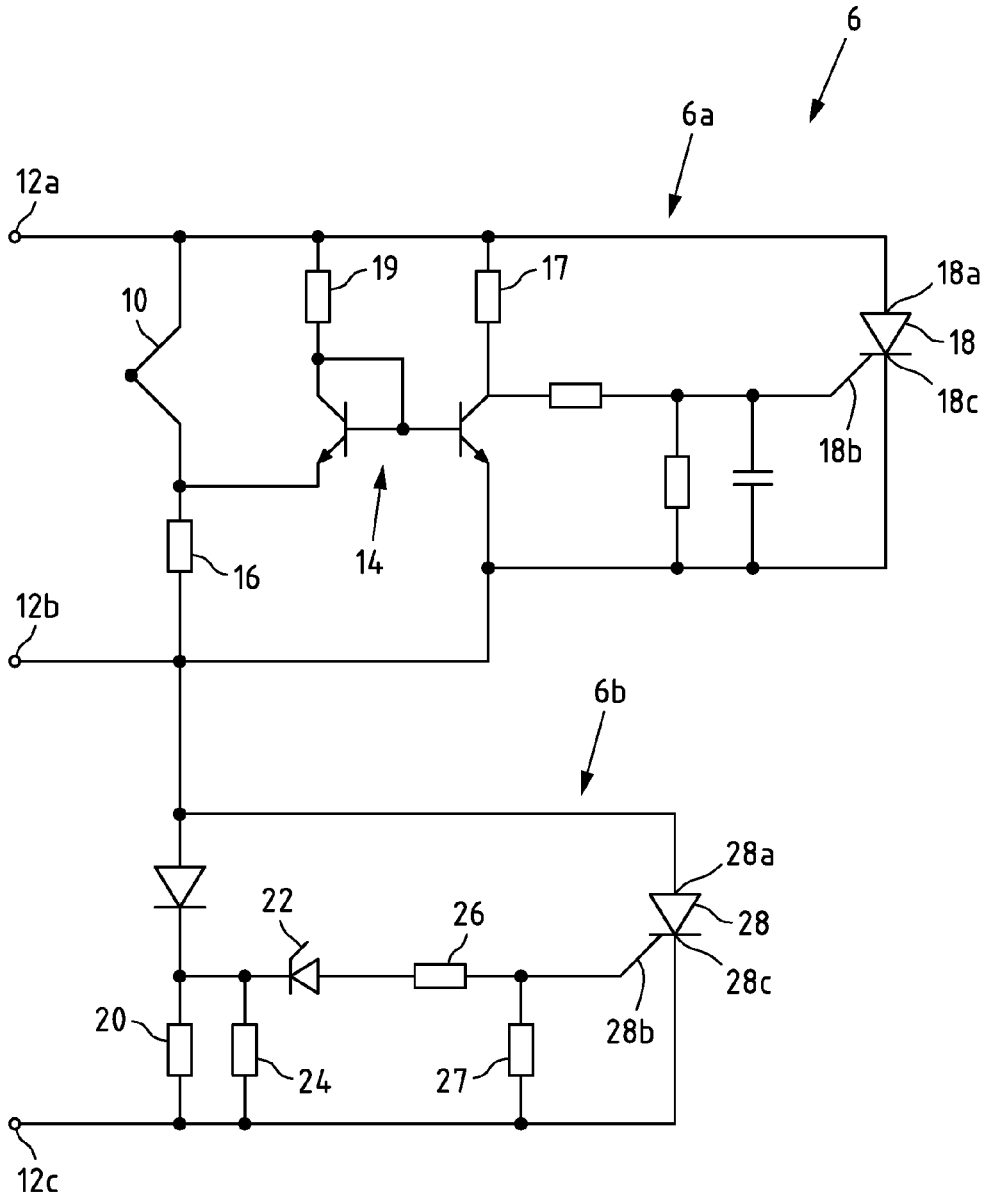
FIG. 2 an embodiment of a circuit on a control connection of a fire-fighting device.

To avoid these non-triggered generators 8, a circuit 6 is proposed as it is explained by way of example in FIG. 2.

In FIG. 2, circuit 6 is shown with an ignition means 10 inside a generator 8. The ignition means 10 for example has an ignition wire with a pyrotechnic charge. Circuit 6 can be connected via the connections 12*a*, 12*b* and 12*c*. Usually one of the circuits 6 is connected along a row as shown in FIG. 1 with the terminals 12*a*, 12*c* to control circuit 2, all other circuits 6 are connected with the terminals 12*a*, 12*b* to control circuit 2. Circuit 6 has a bypass circuit 6*a* and a circuit 6*b* for storing an ignition process. Circuit 6*b* is also called memory circuit 6*b* in the following.

The bypass circuit 6*a* has a current mirror 14 which is connected asymmetrically to the terminals 12*a*, 12*b* via a resistor 16. On the output side of the current mirror 14, a thyristor or TRIAC 18 can be provided, which switches on at a sufficiently high voltage between cathode 18*c* and gate 18*b* and conductively connects the anode 18*a* with cathode 18*c*.

In a monitoring mode, a measuring current of up to 5 mA is passed through the series connection as shown in FIG. 1. The measuring current flows from the connection 12*a* via the ignition means 10 to the connection 12*b* and from there to the next fire-fighting device 4. This is the normal operation mode in which no ignition has taken place yet. With the measuring current via the ignition means, the voltage drop across the ignition means caused by the current flow is so small that the current mirror does not receive its required minimum operating voltage and thus the thyristor 18 blocks.

In case of a fire, the generators 8 should be ignited. For this purpose, an ignition current is applied to circuit 6 in case of a fire.

The ignition current first flows through the ignition means 10, which causes the ignition wire in the ignition means 10 to heat up and finally leads to an activation of the pyrotechnic charge in the ignition means 10 and an activation of the generator 8 to discharge the aerosol.

The moment the ignitor 10 is triggered, the electrical connection across the ignitor 10 may break and the ignitor 10 may block an electrical connection between terminals 12*a*, 12*b*. Due to the missing current flow through resistor 16, the asymmetrical connection of the current mirror 14 is reduced, so that the voltage between the collector of the current mirror 14 and the resistor 17 increases. This causes the ignition current to cause a sufficiently high voltage between the cathode 18*c* and the gate 18*b* of the thyristor 18 and to switch it on.

The ignition current then flows, in spite of a disconnected line in the ignition means 10, through the thyristor 18 between the poles 12*a* and 12*b*. As a result, all fire-fighting devices 4 connected in series are permanently supplied with the ignition current as shown in FIG. 1, even if individual fire-fighting devices 4 or their ignition means 10 have already ignited and cause an electrical disconnection. Thus, the bypass circuit 6*a* ensures reliable operation of all generators 8 along a line of series-connected fire-fighting device 4 at one control circuit 2.

At the moment of ignition, the wire in the ignition means 10 may break open. However, it is also possible that the wire fuses or an electrical connection through the means of ignition 10 remains after ignition in another way. In order to be able to monitor whether at least one means of ignition 10 of the fire-fighting device 4 has ignited along a line, a fire-fighting device 4 can be connected to the line according to FIG. 1 with the connections 12*a* and 12*c*.

In such a case the memory circuit 6*b* is connected to the line. In the memory circuit 6*b*, a fuse 20 is provided which is designed to melt at an ignition current of a duration approximately or slightly shorter than the minimum duration for igniting an ignition means 10. In the case of the ignition current the fuse 20 melts and the Zener diode 22 becomes conductive due to the voltage drop across resistor 24 and breaks through. In this case, a sufficiently high voltage is applied between cathode 28*c* and gate 28*b* of thyristor 28 via resistor 27 and the thyristor 28 becomes conductive.

This means that an ignition current can still flow via circuit 6 between terminals 12*a* and 12*c*, namely via thyristor 28, even if fuse 20 has melted.

On the other hand, a measuring current is regularly introduced into the circuit to check whether it is still functional. If all ignition means 10 are still conductive, the measuring current flows via these ignition means 10. This can also be the case if an ignition means 10 has already ignited but an electrical connection has remained. In this case the measuring current would not be able to determine whether or not at least one fire-fighting device 4 has been ignited.

Since a fire-fighting device 4 is connected in series via terminals 12*a* and 12*c*, the memory circuit 6*b* is also active. As already described, fuse 20 will melt in case of an ignition current. A measuring current then flows via resistor 24. This measuring current is too low, however, for the Zener diode 22 to become conductive and the thyristor 28 remains closed. This means that in case of a measurement via the series connection of the fire-fighting devices 4 along the line according to FIG. 1, a measuring current is routed at least via resistor 24. This causes a voltage drop between the poles 2*a*, 2*b* which can be measured and which from a certain magnitude indicates that the memory circuit 6*b* is activated and that the measuring current flows via resistor 24 and not via an intact fuse 20. This makes it possible to determine that the memory circuit 6*b* has been activated.

With the help of the fire-fighting device according to the subject matter, it is possible to ensure a reliable ignition of fire-fighting devices connected in series at a control circuit.

LIST OF REFERENCE SIGNS

2 control circuit
2*a, b* poles
4 fire-fighting device
6 circuit
6*a* bypass circuit
6*b* memory circuit
8 generator
10 ignition means
12*a-c* connection
14 current mirror
16 resistance
17 resistance
18 thyristor
19 resistance
20 fuse
22 Zener diode
24, 26, 27 resistance
28 thyristor

What is claimed is:

1. A fire-fighting device comprising:

at least one generator arranged for discharging a fire-fighting agent;

an electrically triggerable ignition arranged in the generator, wherein the ignition has an at least two-pole control connection;

a bypass circuit electrically arranged at poles of the control connection; and a switch, wherein the bypass circuit is arranged to monitor an ohmic resistance across the ignition and is connected to the switch in such a way that it closes the switch, to connect the poles of the control connection so as to allow a current to flow between the poles of the control connection across the switch, depending on the resistance across the ignition, and that the bypass circuit is connected to the control connection electrically in parallel.

2. Fire-fighting device according to claim 1, wherein the bypass circuit monitors a current through the ignition and in that the bypass circuit closes the switch for a detected current below a limit value.

3. Fire-fighting device according to claim 1, wherein the bypass circuit has an asymmetrically connected current mirror.

4. Fire-fighting device according to claim 1, wherein the switch is an electronic switch.

5. Fire-fighting device according to claim 1, wherein the at least one generator is a solid aerosol generator.

6. Fire-fighting device according to claim 1, wherein the ignition is a pyrotechnic ignition which can be ignited electrically via a resistance wire.

7. Fire-fighting device according to claim 1, wherein the control connection is formed for an input voltage between 16.8 V and 30 V.

8. Fire-fighting device according to claim 1, wherein a circuit for storing an ignition process is arranged electrically in series with the ignition, wherein the circuit has at least one fuse which triggers during an ignition process and a switch which bypasses the fuse.

9. Fire-fighting device according to claim 8, wherein the switch bypassing the fuse is configured to be open during a monitoring mode.

10. A system comprising a control circuit and at least two of the fire-fighting device according to claim 1 electrically connected in series to the control circuit.

11. A method for operating the system of claim 10, comprising:

in a monitoring mode, providing a measuring current by the control circuit, wherein the measuring current is smaller than an ignition current;

providing the ignition current by the control circuit in an ignition mode;

igniting by the ignition current at least one ignition of a first of the fire-fighting devices; and activating the monitoring circuit associated with the ignited ignition depending on a resistance across the ignition, so that the switch closes and thereby the ignition current flows through at least a second of the fire-fighting devices after the ignition of the first of the fire-fighting devices is ignited.

12. Method according to claim 11, wherein the circuit for storing an ignition process is activated by the ignition current in such a way that a switch of the circuit for storing the ignition process is open in the case of a measuring current and in that the switch is closed in the case of an ignition current which is greater than the measuring current.

13. A rail vehicle equipped with the system according to claim 10.

14. The rail vehicle of claim 13, wherein the control circuit is fed by a voltage source of the rail vehicle, wherein a voltage band of the voltage source is between 16.8 V and 30 V.

* * * * *